US006176294B1

(12) United States Patent
Kuramasu et al.

(10) Patent No.: US 6,176,294 B1
(45) Date of Patent: Jan. 23, 2001

(54) DIE-CASTING METHOD

(75) Inventors: Yukio Kuramasu; Takaaki Ikari, both of Shizuoka-ken (JP)

(73) Assignee: Nippon Light Metal Co., Ltd., Tokyo (JP)

( * ) Notice: Under 35 U.S.C. 154(b), the term of this patent shall be extended for 0 days.

(21) Appl. No.: 09/352,271

(22) Filed: Jul. 13, 1999

(30) Foreign Application Priority Data

Jul. 14, 1998 (JP) ..... 10-198198
Jun. 2, 1999 (JP) ..... 11-154566

(51) Int. Cl.[7] ..... B22D 27/15; B22D 17/00
(52) U.S. Cl. ..... 164/61; 164/113; 164/253; 164/312; 164/457
(58) Field of Search ..... 164/61, 113, 457, 164/253, 312

(56) References Cited

U.S. PATENT DOCUMENTS 4,431,047 * 2/1984 Takeshima ..... 164/253
5,076,344 * 12/1991 Fields et al. ..... 164/457
6,024,158 * 2/2000 Gabathnler ..... 164/61

FOREIGN PATENT DOCUMENTS 50-21143 7/1975 (JP) ..... B22D/17/22
57-140 1/1982 (JP) ..... B22D/17/00
1-46224 10/1989 (JP) ..... B22D/17/00

* cited by examiner

*Primary Examiner*—Harold Pyon
*Assistant Examiner*—I.-H. Lin
(74) *Attorney, Agent, or Firm*—Webb Zeisenheim Logsdon Orkin & Hanson, P.C.

(57) ABSTRACT

After a cavity 2 of a die-casting mold 1 is evacuated to exclude gases, oxygen gas is blown into the cavity 2 until an internal pressure of the cavity exceeds the atmospheric pressure, and then a molten metal 5 is forcibly injected into the cavity 2. The cavity 2 is evacuated to a degree of vacuum less than 100 millibar through a suction nozzle 11. The oxygen gas is blown through a nozzle 14 into the cavity 2 so as to fill the cavity 2 with the oxygen gas at an internal pressure higher than the atmospheric pressure. When the molten metal 5 is injected into the cavity 2 clarified in this way, inclusion of gases is perfectly prohibited. As a result, obtained die-cast products are free from defects such as blowholes or porosity caused by inclusion of gases and so useful as functional members as well as structural members.

1 Claim, 1 Drawing Sheet

DIE-CASTING METHOD

BACKGROUND OF THE INVENTION

The present invention relates to a die-casting method for production of die-cast products useful not only as structural members but also as functional members and die-cast products manufactured thereby.

In a conventional die-casting method, molten aluminum or aluminum alloy (hereinafter referred to as "molten metal") poured into a sleeve is forcibly injected into a cavity of a die-casting mold by a plunger. Most of gases such as air and water vapor are purged from the cavity in response to injection of the molten metal, but some of the gases remain as such in the cavity even after the injection. Especially, die-casting molds designed for production of thin-walled products or products having complicated configurations have portions acting as bottlenecks against gas flow, so that it is difficult to completely remove gases from the cavity.

Gases trapped in the cavity are included in a cast product, when the injected molten metal is cooled and solidified in the cavity. Inclusion of gases causes defects such as blowholes and porosity in die-cast products. Therefore, the die-cast products obtained in this way have been regarded as members unsuitable for functional uses, e.g. scrolls, pistons, cylinder blocks, connecting rods or suspension parts, due to poor mechanical properties. If cast defects derived from inclusion of gases are suppressed, a die-casting method excellent in productivity can be applied to various fields of technology.

In order to eliminate harmful influences derived from inclusion of gases, a vacuum die-casting method was proposed. According to the vacuum die-casting method, a cavity of a die-casting mold is evacuated before injection of molten metal, so as to remove gases from the cavity. The cavity is held at a degree of vacuum in the range of 200–500 millibar by evacuation. However, an internal pressure of the cavity can not be reduced less than said value, due to invasion of air through narrow gaps of dies. Invasion of air also occurs during the pouring of molten metal into a sleeve. As a result, cast defects such as porosity caused by inclusion of gases are detected even in products obtained by the vacuum die-casting method, although inclusion of gases is somewhat decreased as compared with products obtained by a conventional die-casting method. In this regard, the products are not good enough for use as functional members.

An oxygen die-casting method has been developed in order to eliminate defects in the vacuum die-casting method. According to the oxygen die casting method, as disclosed in JP B 50-21143, a cavity of a die-casting mold is filled with oxygen at a pressure higher than the atmospheric pressure so as to replace gases by oxygen prior to injection of molten metal. Since oxygen gas fed into the cavity is effused through narrow gaps of dies as well as an injection hole, invasion of atmospheric gas through the narrow gaps or the injection hole can be prohibited. In addition, the oxygen gas fed into the cavity is reacted with molten metal, and a reaction product $Al_2O_3$ is dispersed as fine particles in a cast product without harmful influences on an obtained die-cast product.

However, complete replacement of gases from the cavity of a die-casting mold by oxygen injection is substantially impossible, even when oxygen is fed into the cavity at a pressure higher than the atmospheric pressure. Gases often remain at difficult portions for the replacement in the cavity. A die-casting mold designed for production of a product having a complicated configuration has difficult portions to which oxygen is hardly reached, so that gases such as air and water vapor can not be replaced by the fed oxygen but remain as such. The residual gases and water vapor from parting agents are included in products and cause defects.

Residual air can be efficiently removed from the cavity by oxygen blowing during evacuation, as disclosed in JP B 57-140. However, simultaneous oxygen blowing with evacuation is not effective for removal of water vapor. In fact, cast defects caused by inclusion of gases are still detected in a cast product obtained by this method. JP B 1-46224 discloses another die-casting method, wherein oxygen blowing is performed after evacuation. However, some cast defects are also detected in a cast product, since a cavity of a die-casting mold is held at a decompressed pressure during the oxygen blowing.

Inclusion of the trapped gases also causes blisters in die-cast products, when the die-cast products are heat-treated in such as T6 treatment (i.e., solution heating, quenching and then aging) for improvement of mechanical properties. In order to avoid such blisters, most of die-cast products are not used with heat treatment.

SUMMARY OF THE INVENTION

The present invention is aimed at elimination of such problems as above-mentioned. The objective of the present invention is to remarkably reduce inclusion of gases by combining advantages of both the vacuum die-casting and the oxygen die-casting for die-cast products useful as functional members.

A die-casting method according to the present invention is characterized by evacuating a cavity of a die-casting mold to a degree of vacuum not higher than 100 millibar for removal of gases as well as water vapor from the cavity, followed by blowing oxygen gas into the cavity, and then forcibly injecting molten metal into the cavity at a time when an internal pressure of the cavity exceeds the atmospheric pressure.

At first, the cavity of the die-casting mold is evacuated to a degree of vacuum not higher than 100 millibar. Gases are effectively discharged from the cavity, especially when the suction speed is higher than 500 millibar/second. The cavity is then filled with oxygen gas at a pressure a little higher than the atmospheric pressure. When the internal pressure of the cavity exceeds the atmospheric pressure, injection of molten metal into the cavity is started.

Since molten metal is injected into the cavity conditioned in this way, gases to be trapped in a cast product are remarkably reduced to a level less than 1 cc/100 g-Al. Consequently, obtained die-cast products have excellent mechanical properties required for functional members. In addition, the die-cast products can be heat-treated in T6 treatment without blisters caused by the trapped gases.

Gases included in a die-cast product are derived from air remaining in a cavity of a die-casting mold in a conventional die-casting method. Such residual air can be substantially reduced by vacuum or oxygen die-casting. However, cast defects caused by trapped gases inevitably occur in an obtained die-cast product, even when the residual air is substantially reduced.

The inventors have researched and examined an effect of gaseous components on cast defects and their origins from various aspects, with respect to a die-cast product from which harmful influences derived from residual air are eliminated by the vacuum or oxygen die-casting method. As a result, the inventors have found that water for diluting parting agents adhering onto an inner surface of a die-casting mold is a main reason for generation of the cast defects and that the influence of water on the cast defects becomes more apparent as residual air in the cavity decreases.

Water with a parting agent is vaporized and discharged as a vapor from the cavity, when the cavity is evacuated. However, commonly used water-based parting agents will take some time to dry up even under vacuum condition. When the cavity is merely evacuated, vaporization of water is likely limited to a surface of the parting agent without vaporization from the interior of the parting agent so that the parting agent is not sufficiently dried up. In addition, generated water vapor is partially left in the cavity and consequently included in molten metal injected into the cavity.

According to the present invention, water with the parting agent is mostly discharged as a vapor from a cavity of a die-casting mold by vacuum evacuation, and the parting agent is sufficiently dried up. Water vapor, which still remains in the cavity, is diffused into oxygen gas and discharged together with the oxygen gas from the cavity in the succeeding oxygen-blowing step. Water with the parting agent is completely discharged by combination of vacuum evacuation with oxygen blowing, so that gas contents in an obtained die-cast product are surprisingly reduced. Vaporization of water from the parting agent is effectively promoted so as to dry up the parting agent, when the cavity is evacuated at a degree of vacuum less than 100 millibar. A suction speed is preferably set at 500 millibar/second or higher. Such high-speed evacuation induces bumping of water, resulting in rapid dehydration.

Before molten metal is injected into a cavity of a die-casting mold, the cavity is conditioned to such the state that air and water vapor are remarkably reduced. As a result, inclusion of gases in a die-cast product is surprisingly suppressed, and the product is free from cast defects derived from gaseous inclusions.

DETAILED DESCRIPTION OF THE INVENTION

Figure 1:
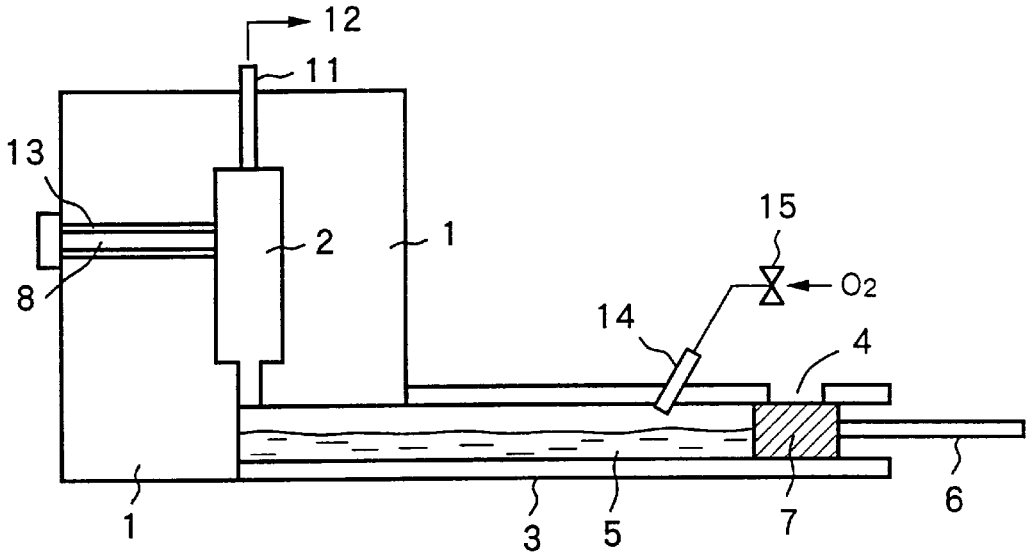
FIG. 1 a schematic view illustrating a die-casting machine to which the present invention is applied.

In a die-casting method, a sleeve 3 attached to a cavity 2 is coupled with a die-casting mold 1, as shown in FIG. 1. The sleeve 3 has a pouring hole 4, through which molten metal 5 is poured in the sleeve 3. The molten metal 5 in the sleeve 3 is pressed by a tip 7 attached to a plunger rod 6 and forcibly injected into the cavity 2. After the cavity 2 is filled with the molten metal 5, the molten metal 5 is cooled and solidified to a profile defined by the inner surface of the die-casting mold 1. A die-cast product obtained in this way is taken from the die-casting mold 1 by pushing ejector pins like 8 in the cavity 2 after the die-cast product is cooled.

According to the present invention, a suction nozzle 11 is attached to the die-casting mold 1 at a proper position such as its parting part, to connect the cavity 2 through the suction nozzle 11 to a vacuum pump 12. When the cavity 2 is evacuated through the suction nozzle 11, atmospheric air could potentially invade through parts where the ejector pins like 8 are inserted during evacuation. Such air invasion is prohibited by sealing gaps between the ejector pins like 8 and the die parts with a sealing agent 13. The pouring hole 4 is closed with the plunger tip 7, so that atmospheric air can not invade into the interior of the sleeve 3 through the pouring hole 4.

In order to blow oxygen into the cavity after the evacuation, an oxygen nozzle 14 is opened to the interior of the sleeve 3. The oxygen nozzle 14 is connected through a regulator valve 15 to an oxygen supply source.

When the cavity 2 is evacuated through the suction nozzle 11, gases such as air and water vapor are excluded from the cavity 2 as well as from the interior of the sleeve 3 connected with the cavity 2. Even if the cavity 2 has a complicated configuration, gases are completely excluded from every nook and corner of the cavity 2 by adjusting a suction speed preferably in a range of 500 millibar/second or higher. Such high-speed evacuation induces bumping of water with a parting agent adhering onto an inner surface of the die-casting mold 1, resulting in remarkable reduction of water vapor from the cavity 2.

The evacuation is preferably continued 1–2 seconds or so, under the condition that the pouring hole 4 is closed with the plunger tip 7. The evacuation time period is set relatively longer, compared with a conventional vacuum die-casting method whereby the cavity 2 is evacuated for a time period shorter than 1 second without closing the pouring hole 4. The cavity 2 is evacuated to a degree of vacuum less than 100 millibar due to the longer evacuation period. Water vapor derived from a parting agent adhering onto the inner surface of the die-casting mold 1 is separated from the inner surface of the die-casting mold and discharged outside.

Removal of water vapor is more effectively performed by the evacuation compared with blowing oxygen gas into the cavity, since a gas stream flows at a higher speed in the cavity 2. However, when the cavity 2 is evacuated to an insufficient degree of vacuum above 100 millibar, a relatively large amount of gases remains in the cavity 2. A large amount of the gases remaining in the cavity 2 are not replaced by oxygen in the following oxygen-blowing step but often included in a cast product. On the other hand, when the cavity is evacuated at a degree of vacuum less than 100 millibar, water with a parting agent is acceleratively vaporized and discharged as a vapor outside the cavity 1. Reduction of water is surprisingly accelerated by high-speed evacuation above 500 millibar/second, which induces bumping of water. Bumping enables vaporization of water not only from a surface but also from an interior of the parting agent, so that residual water is extremely reduced. An upper limit of the suction speed is approximately 800 millibar/second or so, accounting a capacity of available vacuum equipment.

After the evacuation, oxygen gas is blown through the nozzle 14 into the cavity 2. The oxygen supply is continued preferably 3–4 seconds until gasses and oxygen are effused through the parting part of the die-casting mold 1. Since oxygen gas is blown into the cavity 2 in the state decompressed in the former step, the oxygen gas flows as a high-speed stream to every nook and corner of the cavity 2. Water vapor, which is derived from water with the parting agent and left in the cavity 2, diffuses in the oxygen gas and discharged together with the oxygen gas outside the cavity 2. This effect of oxygen blowing on removal of a water vapor is not expected from any method disclosed in JP B 57-140 or JP B 1-46224, wherein oxygen gas is blown in a cavity held under decompressed condition.

Figure 2:
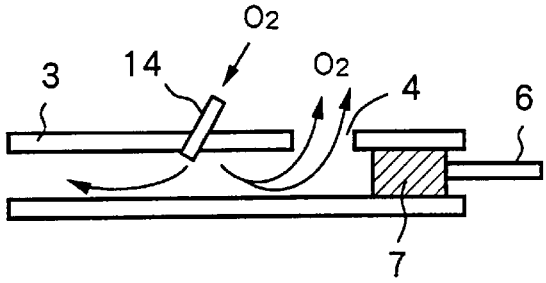
FIG. 2 is a view for explaining blowing oxygen through a sleeve into a cavity of a die-casting mold.
Figure 3:
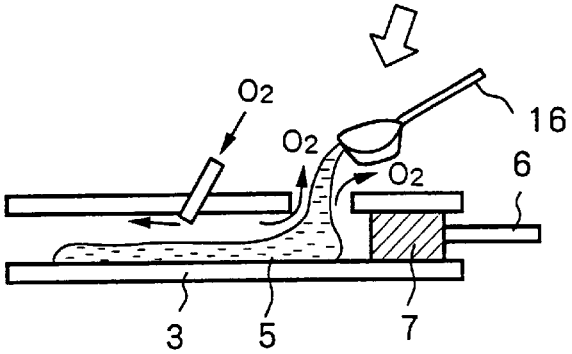
FIG. 3 is a view for explaining pouring a molten metal into a sleeve.

The plunger tip 7 goes back to open the pouring hole 4 during continuation of the oxygen blowing. When the pouring hole 4 is released, oxygen gas is effused through the pouring hole 4, as shown in FIG. 2. Effusion of the oxygen gas effectively inhibits invasion of atmospheric air through the pouring hole 4 into the sleeve 3.

After the pouring hole 4 opens, molten metal 5 is poured from a ladle 16 into the sleeve 3. Since the oxygen gas is continuously effused during the pouring operation, the effusion of the oxygen gas effectively inhibits inflow of atmospheric air in accompaniment with the molten metal 5.

The die-casting mold 1 is preferably preheated at 150–200° C. before the pouring step, in order to reduce thermal shock caused by the poured molten metal 5 and to improve productivity.

After the molten metal 5 in a mass necessary for one cycle of die-casting is poured into the sleeve 3, a plunger rod 6 is forwarded. The pouring hole 4 is closed by forward movement of the plunger rod 6. Since the closed state does not permit inflow of atmospheric air through the pouring hole 4 into the sleeve 3, supply of oxygen gas can be stopped.

After gases such as air and water vapor are completely excluded from the cavity 2 and the interior of the sleeve 3 as above-mentioned, the plunger rod 6 is forwarded to forcibly inject the molten metal 5 into the cavity 2. The injected molten metal 5 is shaped to a bulk having a profile imitating the inner surface of the die-casting mold 1. The bulk is cooled and solidified to a die-cast product having a predetermined configuration. Hereon, cast defects such as blowholes or porosity caused by inclusion of gases are not generated in the die-cast product, since gases such as air and water vapor are completely excluded from the cavity 2. Oxygen gas remaining in the cavity 2 is reacted with the injected molten metal 5, and the reaction product $Al_2O_3$ is dispersed as fine particles in the die-cast product without causing any harmful influences. Consequently, the die-cast products obtained in this way have excellent properties.

EXAMPLE

A die-casting mold 1 used in this example had a cavity 2 of 150 mm in diameter and 120 mm in length. Proper water-cooling means was provided at the die-casting mold 1 for partially cooling the die-casting mold 1.

After the cavity 2 was cleaned by air blow, a parting agent diluted with water was sprayed 5 seconds onto an inner surface of the die-casting mold 1. The die-casting mold 1 was then preheated at 180° C. and located at a proper position in a die-casting machine. The surrounding around ejector pins like 8 was sealed with a sealing agent 13, and a suction nozzle 11 was attached to a parting part of the die-casting mold 1.

The pouring hole 4 was closed with a plunger tip 7, and gases were sucked through the suction nozzle 11 from the cavity 2 and the interior of a sleeve 3 by evacuating the cavity 2 at a suction speed 700 millibar/second. A vacuum gage (not shown) provided at a vacuum system 12 indicated 75 millibar.

After the evacuation, a regulator valve 15 was opened to blow oxygen gas through an oxygen nozzle 14 into the cavity 2. Oxygen blowing was continued until oxygen gas was effused through the parting part of the die-casting mold 1.

After oxygen blowing was continued 3.5 seconds, the plunger tip 7 went back to open the pouring hole 4. Thereafter, molten aluminum alloy ADC12 prepared by conventional molten metal treatment was poured through the pouring hole 4 into the sleeve 3. While the molten metal 5 was poured into the sleeve 3 for 5 seconds, oxygen gas was continuously blown through the oxygen nozzle 14 into the sleeve 3.

After the pouring was finished, the supply of oxygen gas was stopped, and the plunger rod 6 was forwarded to forcibly inject the molten metal 5 into the cavity 2. Injection of the molten metal 5 was completed in a very short time of approximately 0.1 seconds.

It took 5 seconds to solidify the injected molten metal 5 in the die-casting mold 1. After the die-cast product was cooled, it was taken from the die-casting mold 1. The die-cast product No. 1 obtained in this way was subjected to Ransley test for measuring gas contents included therein and also to a mechanical test.

For comparison, a die-cast product No. 2 obtained by a conventional vacuum die-casting method and a die-cast product No. 3 obtained by a conventional oxygen die-casting method from the same aluminum alloy were also subjected to the same Ransley and mechanical tests. In the vacuum die-casting method, the cavity 2 was evacuated 1.5 seconds before injection of the molten metal 5. In the oxygen die-casting method, oxygen gas was blown 2 seconds into the cavity 2, and then the molten metal 5 was injected into the cavity 2 for further 5 seconds while blowing oxygen gas.

The test results are shown in Table 1. It is noted from Table 1 that the amount of gases such as $N_2$ and $H_2$ in the die-cast product No. 1 according to the present invention is extremely reduced as compared with values in the die-cast products Nos. 2 and 3. The die-cast product No. 1 had ductility and tensile strength superior to those values of the die-cast products Nos. 2 and 3. In addition, the die-cast product No. 1 was improved in mechanical properties by T6 treatment (i.e., heating 3 hours at 480° C., water quenching and then aging 5 hours at 160° C.) without generation of blisters due to the extremely reduced gaseous impurities.

TABLE 1

EFFECTS OF DIE-CASTING METHODS ON PROPERTIES OF DIE-CAST PRODUCTS

| Sample | Die-Casting | Amount of gaseous Impurities | As Cast | | After T6 Treatment | |
|---|---|---|---|---|---|---|
| No. | Method | (cc/100 g-Al) | T.S. | El. | T.S. | El. |
| 1 | Present Invention | 0.6 | 32 | 2.0 | 40 | 5.0 |
| 2 | Vacuum Die-Casting | 6 | 23 | 0.8 | Blisters of 1–2 mm in diam. | |
| 3 | Oxygen Die-Casting | 2 | 27 | 1.5 | Blisters of 0.2–0.5 mm in diam. | |

NOTE: T.S. means tensile strength (kg/mm$^2$).
El. means elongation (%).

Furthermore, die-casting was performed under the same conditions except that a suction speed was varied in the range of 100–800 millibar/second. Each die-cast product was subjected to Ransley test to measure an amount of residual gases therein. Remarkable reduction of residual gases was noted at a suction speed above 500 millibar/second. The result means that the high-speed evacuation induces bumping of water with a parting agent adhering onto an inner surface of a die-casting mold and accelerates exclusion of water from the cavity 2.

According to the present invention as above-mentioned, gases such as air and water vapor derived from a parting agent adhering onto an inner surface of a die-casting mold are completely excluded from the cavity of the die-casting mold by oxygen blowing in succession to evacuation until an internal pressure of the cavity exceeds the atmospheric pressure. Since molten metal is injected into the cavity conditioned to the state perfectly free from harmful gases, an obtained die-cast product does not include defects such as blowholes or porosity caused by the gases such as residual air or water vapor. Consequently, this new die-casting method is applicable for production of functional members as well as structural members, using the advantages of high productivity.

What is claimed is:

1. A method of die-casting aluminum or aluminum alloy, comprising the steps of:

evacuating a cavity of a die-casting mold to a vacuum of degree less than 100 millibar to discharge gases from said cavity at a suction speed of 500 millibar/second or higher in order to acclerate evacuating water with a parting agent, blowing oxygen gas into said cavity until an internal pressure of said cavity exceeds the atmospheric pressure, and then forcibly injecting molten aluminum or aluminum alloy into said cavity.

* * * * *